United States Patent [19]

Wood et al.

[11] 4,273,591

[45] Jun. 16, 1981

[54] METHOD AND APPARATUS FOR PREVENTION OF CLOGGING OF EXHAUST SYSTEMS

[75] Inventors: William G. Wood, Grosse Pointe Farms; John F. Pilznienski, Dearborn Heights, both of Mich.

[73] Assignee: Kolene Corp, Detroit, Mich.

[21] Appl. No.: 82,020

[22] Filed: Oct. 5, 1979

[51] Int. Cl.[3] ..... B08B 9/02

[52] U.S. Cl. ..... 134/11; 134/31; 134/22 C; 134/107; 134/166 C; 266/107; 266/120

[58] Field of Search ..... 134/11, 12, 22 R, 22 C, 134/31, 42, 106, 107, 115 R, 166 R, 166 C, 169 R, 169 C, 186, 190, 201; 266/107, 120; 423/DIG. 12; 126/299 D, 299 E

[56] References Cited

U.S. PATENT DOCUMENTS

| | | | |
|---|---|---|---|
| 3,399,877 | 9/1968 | Birjukova | 266/120 |
| 3,605,279 | 9/1971 | Fiser et al. | 134/107 X |
| 3,620,800 | 11/1971 | Tamai et al. | 134/107 X |
| 4,109,897 | 8/1978 | Mehrkam | 266/120 |
| 4,113,511 | 9/1978 | Shoemaker et al. | 134/10 |

*Primary Examiner*—Marc L. Caroff
*Attorney, Agent, or Firm*—William N. Hogg

[57] ABSTRACT

A method and apparatus is disclosed for prevention of clogging of exhaust systems, especially the exhaust hoods and ducts above fused salt baths onto which salts splatter as they are being added by spraying from aqueous solutions. A fluid tight jacket surrounds a portion of the exhaust pipe and hood and a cooling fluid, preferably the aqueous solution of the salt being added is flowed through the jacket. This will condense the water of the solvent onto the inside of the hood and duct dissolving and washing away any splattered salt.

9 Claims, 3 Drawing Figures

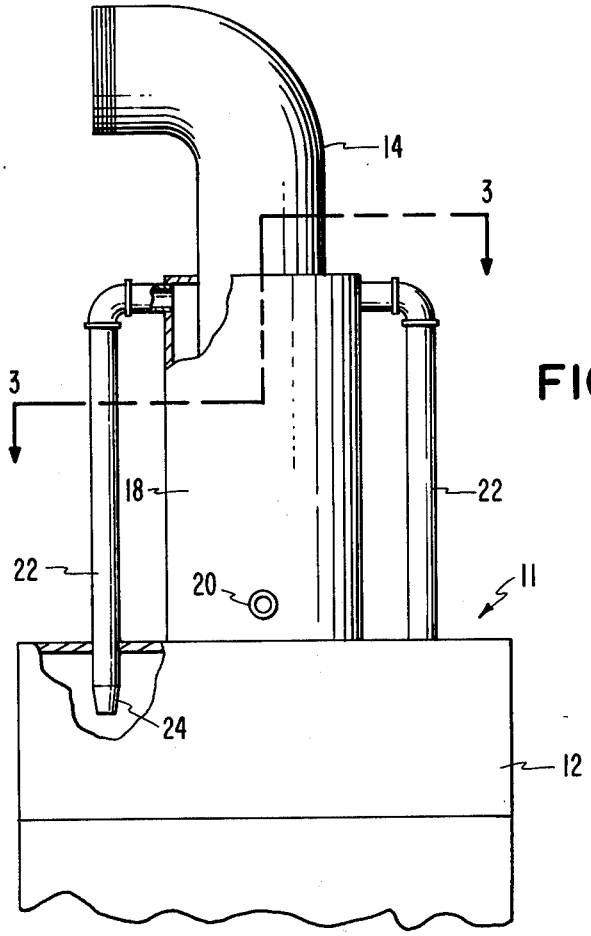
FIG. 2
FIG. 3
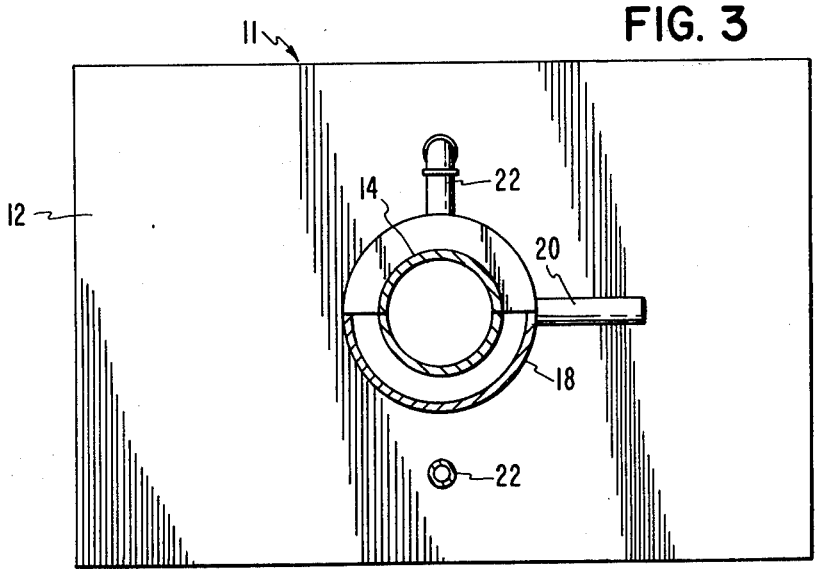

METHOD AND APPARATUS FOR PREVENTION OF CLOGGING OF EXHAUST SYSTEMS

BACKGROUND OF THE INVENTION

This invention relates generally to the addition of chemicals to fused baths, and more particularly to the addition of aqueous solutions of materials to essentially non-aqueous fused baths. Application Ser. No. 759,763, filed Jan. 17, 1977, entitled, "Liquid Additions to Fused Chemicals Baths", now U.S. Pat. No. 4,113,511 and commonly assigned herewith, discloses a system for addition of aqueous solutions of chemicals to essentially non-aqueous fused chemical baths. (These baths are normally referred to as "salt" baths in the trade although they may contain chemicals which are not defined as salts in classical chemical definitions, e.g. hydroxides, permanganates, etc.) Typical examples of such baths are described in U.S. Pat. Nos. 3,790,489; 3,260,619; as well as many other patents.

Said Application Ser. No. 759,763 describes how aqueous solutions of the chemicals are sprayed through nozzles under a hood onto fused high temperature baths. The water is vaporized into steam under a hood, and the steam is exhausted through a duct while the remaining chemicals fall onto the fused bath. Agitation of the bath mixes the essentially non-aqueous chemicals into the bath. The duct in this prior application communicates with the main hood. Such aqueous solution liquid addition has been found to be an excellent way to add materials to a fused bath, giving good control of added material, and allowing great flexibility in the addition of material to fused baths.

However, it has been found that with this type of aqueous solution liquid addition there may, and often does, occur appreciable amounts of splattering of the fused salt in the region where the material is being added. Some of the splattering material strikes this hood and solidifies thereon. As the additions continue, the material builds up on the interior of the hood. This build up often collects around the opening between the duct and the hood tending to clog this opening and preventing the discharge of the steam from the hood. This forces the steam out around the hood. Since the hood is partially submerged in the bath, this actually causes the steam to enter the bath to get out from the hood, causing much splattering and an unsafe condition.

SUMMARY OF THE INVENTION

According to the present invention, a method and apparatus are provided for the addition of a solution, preferably an aqueous solution, of chemicals to fused chemical baths by spraying the solution onto the bath under a solvent exhaust system wherein a liquid preferably the solution of the material is utilized to condense evaporated solvent onto the internal walls of the exhaust system. This will dissolve and wash away material which has splattered and solidified on the duct and hood, and at their junction, tending to keep them clean and the opening functioning to exhaust the solvent.

DESCRIPTION OF THE DRAWINGS

FIG. 2 is a detailed front elevational view of a portion of the device of FIG. 1; and FIG. 3 is a sectional view taken substantially along the plane designated by the line 3—3 of FIG. 2.

DESCRIPTION OF THE PREFERRED EMBODIMENT

Figure 1:
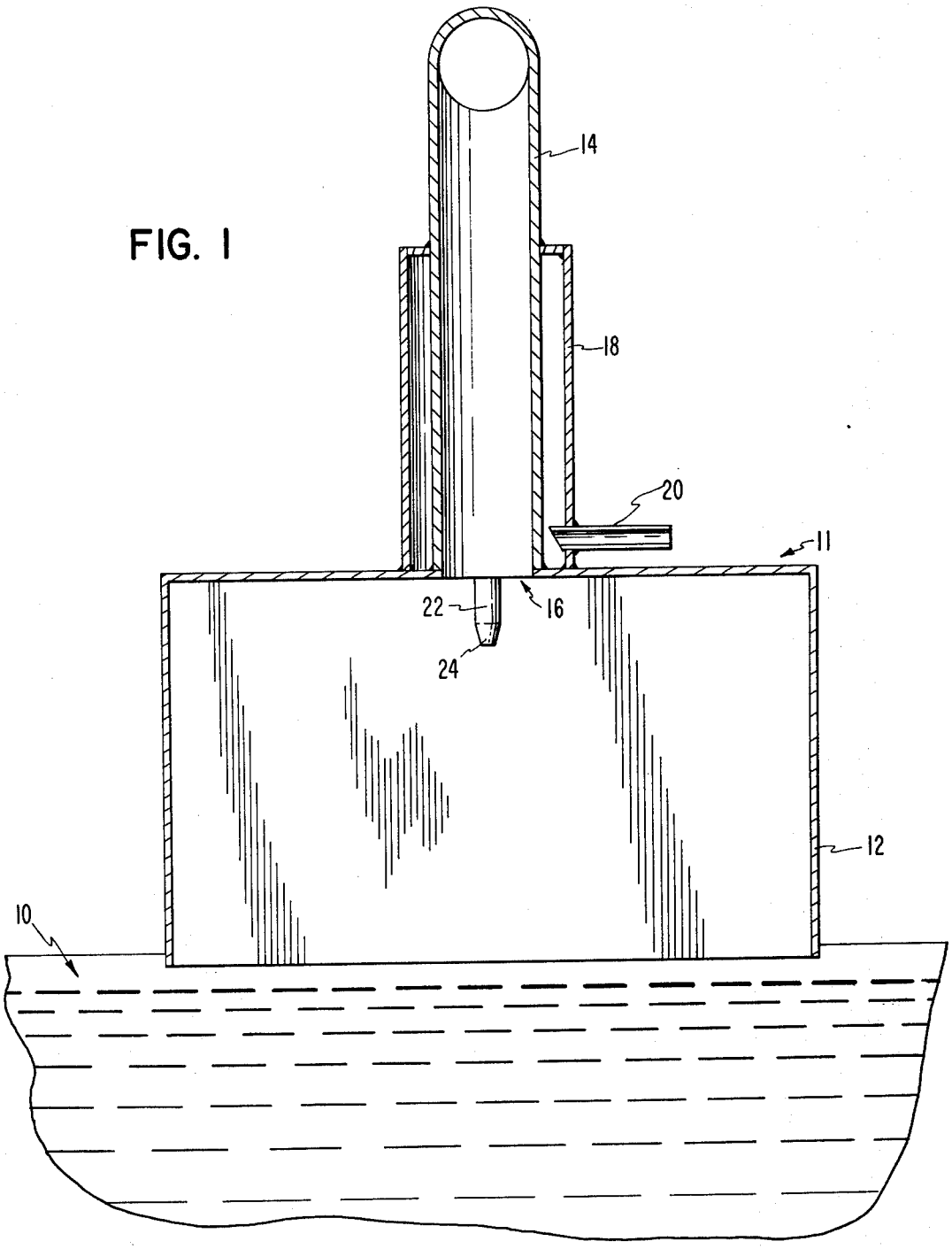
FIG. 1 is a side elevational view partially in section showing a device according to this invention for adding an aqueous solution of a chemical to a fused chemical bath.

The present invention will be described as it is used to add an aqueous solution of a chemical to an essentially non-aqueous fused bath of a chemical which has a melting point higher than the boiling point of water. However, this invention is applicable to any solvent/solute addition to a fused bath having a higher melting point than the boiling point of the solvent used to dissolve the solution.

Referring now to the drawing, an essentially non-aqueous fused chemical bath, generally referred to as a salt bath is shown, somewhat diagramatically, and designated by the reference character 10. The bath conventionally is agitated by any suitable agitation means (not shown) to insure uniformity of the bath and adequate mixing of any additions to the bath.

A device for the addition of chemicals in aqueous solution to the bath by spraying the solution above the bath is shown and generally designated by the reference character 11. The device includes a hood 12 which extends down to slightly below the surface of the bath 10. This will insure that additions are contained within the hood and won't cause splatter outside the hood. The hood 12 communicates with an exhaust duct 14 through an opening 16. This duct 14 may exhaust directly to ambient atmosphere, or it may be connected to a larger hood as shown and described in said Application Ser. No. 759,763.

A fluid tight jacket 18 surrounds the exhaust. On the inside, the jacket is bounded by the duct 14 and the top surface of the hood 12. A fluid supply conduit 20 communicates with the jacket 12 at the lower end thereof near the hood 12 and is adapted to supply the aqueous solution of chemicals to be added from a supply (not shown). This supply is preferably pumped from a supply tank as shown in said Appln. Ser. No. 759,763.

Extending down from the top end of the jacket 18 are a pair of outlet pipes 22. The pipes 22 extend downward through the top of the hood 12 and each terminates in a nozzle 24 within the hood. The nozzles 24 are selected so that they will atomize the aqueous solution of the chemical above the top of the bath 10 within the hood 12.

In operation an aqueous solution of the material to be added to the bath is supplied through the supply conduit 20. The solution enters the jacket 18, surrounding and contacting the duct 14 and the top of the hood 12. Normally, the solution will be supplied at ambient temperature.

The solution will fill the jacket 18, flowing from the bottom to the top, and discharge from the top through pipes 22 to the nozzles 24. The solution will be atomized into small droplets, and the heat from the fused bath, which is maintained well above 100° C. will vaporize the water to steam driving it off, and will allow the chemical solute to enter into the bath.

The bath is normally agitated, or stirred, and this stirring together with the material entering the bath will tend to cause the bath to splatter. Some of the splattered material will contact the hood, and even go into the exhaust duct. As described above, this can gradually cause the opening 16 to become partially or even completely blocked forcing the steam out from under the hood. This is a dangerous situation because of unwanted splattering which can occur outside the hood.

However, the flowing solution in the jacket 18 is in heat conducting contact with the duct 14 and the top of the hood 12 which will cool the duct and top of the hood to below 100° C., thus causing steam that is in contact with the duct to condense on the inner wall thereof as water drops. These drops of water condensing on the inside wall of the duct will tend to dissolve and wash away encrusted splattered material on the inside surface of the duct and into the hood. This will keep open the opening 16 and prevent, or substantially reduce encrusting of splattered material thereon. The important location to keep free of splatter is the opening 16, and hence, the region surrounding this opening is the region which must be cooled. This is principally above the opening, which is the region of the duct 14, although it is desirable that a portion of the hood also be included.

Another benefit also derived from this arrangement is that there will be a certain amount of preheating of the solution before it is sprayed from the nozzles. This makes the evaporation of the solvent easier.

The invention has been described using the aqueous solution of the material itself which is being added as the cooling agent; and this is the preferred embodiment. However, the jacket could be supplied with plain water or other fluid as a cooling medium. In such a case the aqueous solution of material to be added would be supplied directly to the nozzles.

We claim:

1. In a device for adding a solvent solution of a chemical composition to an essentially non-aqueous solvent containing fused bath of a chemical composition wherein the solvent solution is sprayed above the surface of the fused bath the improvement comprising, solvent exhaust means disposed above the fused bath including a hood and an exhaust duct communicating with the hood, fluid supply means for supplying the solvent solution and solvent solution discharge means to spray the solution onto the bath under the hood, fluid tight jacket means surrounding said exhaust means adjacent the location where the duct communicates with the hood, means to supply a fluid to and exhaust fluid from said fluid tight jacket means, whereby fluid flowing through the jacket will cause condensation of some solvent on the interior surface of the exhaust means thereby dissolving and washing away material which has splattered from the bath and solidified on the exhaust duct and hood and at the junction of the exhaust duct and hood.

2. The invention as defined in claim 1 wherein the fluid tight jacket means is connected to receive the solvent solution as the fluid in the jacket and to discharge said solvent solution to the discharge means.

3. The invention as defined in claim 2 wherein the jacket surrounds a portion of the duct adjacent the location where the hood and duct are in communication.

4. The invention as defined in claim 3 wherein the jacket surrounds a portion of the hood adjacent the location where the hood and duct are in communication.

5. The invention as defined in claim 2 wherein said fluid discharge means includes fluid conducting pipe means extending through said hood and terminating in nozzle means.

6. The invention as defined in claim 1 wherein said means to supply fluid to said jacket communicates with said jacket closer to said hood than does said means to exhaust fluid from said jacket.

7. In a method of preventing the build up of material in a device for adding solvent solutions of a chemical to an essentially solvent free fused bath of a chemical composition by spraying the solvent solution onto the bath. and wherein the bath has sufficient heat to vaporize the solvent and which device includes wall means defining a solvent exhaust system having a hood, an exhaust duct communicating with said hood, and fluid conducting means disposed to deliver the solvent solution to be sprayed onto the fused bath under the hood, the improvement which comprises providing fluid tight jacket means surrounding said exhaust system in the region where said exhaust duct and said hood communicate, said fluid tight jacket means being in heat conducting relationship with said exhaust system, and passing cooling fluid through said jacket at a temperature below the boiling point of the solvent whereby to condense solvent onto the walls of the exhaust system to thereby dissolve and remove splattered chemical composition on the duct wall.

8. The method of claim 7 wherein the solvent is water.

9. The invention as defined in claim 7 wherein the cooling fluid is said solvent solution.

* * * * *